United States Patent [19]

von der Eltz

[11] 4,264,321

[45] Apr. 28, 1981

[54] PROCESS FOR THE PAD DYEING OR PRINTING OF CELLULOSE FIBERS WITH REACTIVE DYES

[75] Inventor: Hans-Ulrich von der Eltz, Frankfurt am Main, Fed. Rep. of Germany

[73] Assignee: Hoechst Aktiengesellschaft, Frankfurt am Main, Fed. Rep. of Germany

[21] Appl. No.: 64,776

[22] Filed: Aug. 8, 1979

[30] Foreign Application Priority Data

Aug. 10, 1978 [DE] Fed. Rep. of Germany ..... 2834998

[51] Int. Cl.[3] ..... D06P 3/66

[52] U.S. Cl. ..... 8/476; 8/532; 8/543; 8/638; 8/918; 8/934

[58] Field of Search ..... 8/1 A, 21 C, 25, 542, 8/476, 532, 543, 918, 934

[56] References Cited

U.S. PATENT DOCUMENTS

| | | | |
|---|---|---|---|
| 3,767,356 | 10/1973 | Turner | 8/21 C |
| 3,795,481 | 3/1974 | von der Eltz et al. | 8/26 |
| 4,078,885 | 5/1978 | Opitz et al. | 8/1 A |

FOREIGN PATENT DOCUMENTS 1085256 9/1967 United Kingdom .

*Primary Examiner*—A. Lionel Clingman
*Attorney, Agent, or Firm*—Curtis, Morris & Safford

[57] ABSTRACT

A process is disclosed for the pad-dyeing or printing of web-like textiles consisting totally or partially of cellulose fibers, with aqueous padding liquors or printing pastes containing one or several reactive dyes and optionally, thickening and padding auxiliaries, the starting pH values of the liquors and pastes being in the slightly acid range, which comprises fixing the padded or printed dyestuffs, without the addition of alkalis or alkali-yielding agents, by subjecting the dyestuffs to high-pressure steam or high temperature steam or dry heat.

9 Claims, No Drawings

PROCESS FOR THE PAD DYEING OR PRINTING OF CELLULOSE FIBERS WITH REACTIVE DYES

The present invention relates to a process for the pad-dyeing or printing of cellulose fibers with reactive dyes.

The present invention provides a process for the pad-dyeing or printing of web-like textiles of cellulose fibers, and/or of the cellulose fiber portion of mixtures with polyester fibers, with aqueous padding liquors or printing pastes containing one or several reactive dyes and optionally thickening or padding auxiliaries, the starting pH values of said liquors or pastes being in the slightly acid range. In the case of such fiber mixtures the mode of operation according to the invention is especially important for the one-phase pad-dyeing and printing with combinations of reactive and disperse dyes.

In German Patent No. 1,280,809 and British Patent Specification No. 921,550 there have been described processes for the pad-dyeing or printing of cellulose fiber materials with reactive dyes, wherein the presence of agents exerting an alkaline effect in the course of the thermal treatment for the fixation of these dyestuffs is assumed.

From German Patent No. 1,619,467 a process is known according to which pad-dyeings or prints with reactive and disperse dyes on mixtures of cellulose and polyester fibers are fixed simultaneously at elevated temperatures. In this case the aqueous padding liquors or printing pastes contain, besides such dyestuffs, alkalis and, optionally, carriers, halogen-containing organic compounds acting as acid-yielding agents which react with water in the heat, while splitting off hydrogen halide. The fixation of the different dyestuffs is subsequently effected under temperature and time conditions common for the fixation of disperse dyes by pressure steaming at a temperature of more than 100° C. or by dry heat (thermosoling) at a temperature of more than 130° C.

Nevertheless, a process of this kind involves certain drawbacks, since the simultaneous fixation of reactive and disperse dyes on mixtures of cellulose and polyester fibers is difficult due to contrasts in the favorable heating periods for fixation of the disperse and reactive dyes, as well as the pH values of the dyestuff compositions. The difficulties lie in the fact that on the one hand the alkali present in the fixation medium for the reactive dyes shows an adverse effect on the dyeings with the disperse dye, in that it affects the shade and fastness properties of the latter, and that on the other hand the relatively long action period of acids during the heat fixation is hazardous for the binding and the shade of the reactive dyes. This entails alterations in shade and losses of the dyestuff yield for the reactive and disperse dyes.

It has also been proposed to apply reactive dyes under slightly acid conditions onto cellulose fibers in special cases. However, the padding liquors and/or printing pastes employed for this purpose always contain substances which at elevated temperatures yield the alkali required for the dyestuff fixation.

It is, therefore, an object of the present invention, within the framework of conventional one-phase processes for the pad-dyeing or printing of, preferably, mixtures of cellulose fibers and polyester fibers while using reactive dyes, to maintain the stable state of distribution of the disperse dyes and also to treat carefully the reactive dye during the dyeing process, thus preventing changes of shade. Besides, as compared with the relevant state of the art, the process is simpler with regard to the measures required for the production of such pad-dyeings and prints, and the results are independent of random fluctuations of temperature.

This task is solved according to the invention by fixing the dyestuffs padded or printed onto the materials without the addition of alkalis or alkali-yielding agents by subjecting the dyestuffs to high-pressure steam or high temperature steam, or to dry heat.

In view of the fact that prior common processes for the pad-dyeing and printing of web-like textiles of cellulose fibers with reactive dyes, according to all variants for the fixation of these dyestuffs, are effected with the aid of alkalis or alkali-yielding agents, it was surprising that under the high temperature conditions of the invention cellulose fiber articles may be dyed or printed with reactive dyes without the addition of alkalis or alkali-yielding agents. It is hypothesized that besides the normal reaction between the dyestuff and the cellulose fiber there is a relationship different from that with the conventional alkaline fixation processes, although a covalent binding of the dyestuff to the cellulose fiber with the corresponding fastness properties is attained.

The process of the invention may preferably be considered for the one-phase pad-dyeing and printing of mixtures of cellulose and polyester fibers, wherein the advantages of the novel application technique for the reactive dyes become particularly evident. In these cases the padding liquors or printing pastes employed contain additionally disperse dyes and, optionally carriers, padding auxiliaries and hydrotropic agents; however, the use of acid-yielding agents is not required.

When carrying out the process of the invention, the two dyestuff components present in the case of fiber mixtures are dissolved and/or predispersed in common manner and are added, optionally together with hydrotropic agents, to the aqueous padding liquors and/or the common printing thickeners. The pH values of these liquors and/or printing pastes (measured at 20° C.) should be in the slightly acid range; a pH adjustment is not required in many cases, as aqueous solutions of reactive dyes (in a commercial form and quality) are slightly acid per se. By slightly acid pH conditions there is to be understood generally a range of from 4.0 to 6.8, preferably from 5.5 to 6.5. However, process waters which have been softened with cation exchangers are frequently slightly alkaline and therefore require a pH correction to the above-mentioned range. In some cases the simultaneous use of products protecting the dyestuff from reduction, for example those based on m-nitrobenzene sulfonates, may be advantageous. Due to the absence of alkali in the compositions, the stability of padding liquors and printing pastes is increased.

While using the padding liquors and/or printing pastes prepared in the manner described above, the textile material is padded at 30° C. to 60° C. and/or printed at room temperature; subsequently the goods thus treated are steamed—if dyestuff combinations are present—for the simultaneous fixation of both dyestuff classes, discontinuously in a pressure steamer by means of saturated steam of 105° to 140° C. for from 2 to 30 minutes, preferably from 3 to 20 minutes, or in a high temperature steamer for from 3 to 7 minutes with superheated steam of 160° to 190° C., or the goods are fixed by way of dry heat for a period of from 45 to 120 seconds at 180° to 230° C. A short high temperature steaming process may optionally be followed by a thermosoling process. This is particularly advantageous in the case of continuous pressure steamers with which a shorter dwelling time for the complete fixation of the disperse dyes is typical.

The after-treatment of the dyeings and prints produced in accordance with the invention depends on the dyestuffs employed. Generally it may be simplified to a high degree. In many cases the goods need only to be rinsed with water of a temperature of from 60° to 70° C. and with cold water.

For the dyeing and printing of cellulose fibers and/or of the cellulose fiber portion of fiber mixtures according to the present invention the reactive dyes to be employed are the organic dyestuffs known by this term, independently of the nature of their reactive groups. This class of dyestuffs is termed "Reactive Dyes" in *Colour Index,* 3rd edition, 1971. The dyestuffs concerned are predominantly those dyestuffs which contain at least one group which is able to react with polyhydroxyl fibers, a precursor of the same, or a substituent that can be reacted with the polyhydroxyl fiber. As basic substances of the organic dyestuffs the members of the series of azo, anthraquinone and phthalocyanine dyestuffs are especially suitable, the azo and phthalocyanine dyestuffs being either free from metal or containing metal. Examples of reactive groups and precursors forming these reactive groups are epoxy groups, the ethylene imide group, the vinyl grouping in the vinylsulfone or acrylic acid radical, and moreover, the β-sulfatoethylsulfone group, the β-chloroethylsulfone group or the β-dialkylamino-ethylsulfone group. Also suitable for this process are derivatives of the tetrafluorocyclobutyl series, for example tetrafluorocyclobutylacrylic acid. As reactive substituents in reactive dyes there may be used those which can easily be split off and leave an electrophilic radical. Examples of such, are from 1 to 3 halogen atoms substituted in the following ring systems: Quinoxaline, triazine, pyrimidine, phthalazine, pyridazine and pyridazone. Use may also be made of dyestuffs having several homogeneous or heterogeneous reactive groups.

As disperse dyestuffs for the dyeing or printing of the polyester fiber component there are suitable all water-insoluble dyestuffs which are specified in *Colour Index,* 3rd edition, 1971, under the term of "Disperse Dyes". Products of this kind are based on, for example, members of the series of azo, anthraquinone or quinophthalone dyestuffs, the azo dyestuffs being employed either in a metal-containing form or a metal-free form. Dyestuffs of the above-mentioned category are sufficiently known.

Hydrotropic substances suitable for use in the invention are those products whose boiling point is above the thermal fixation temperature, for example polyhydric alcohols of the glycerol type, polyethylene-glycols or polypropylene-glycols with molecular weights of from 200 to 800.

The following Examples serve to illustrate the invention.

EXAMPLE 1:

A mixed fabric of 67% of polyester fibers and 33% of cotton is padded, at a liquor pick-up of 70% (of the weight of the dry goods), with an aqueous padding liquor at a temperature of 60° C. having the following composition:

7.9 g/l of the disperse dye of the formula

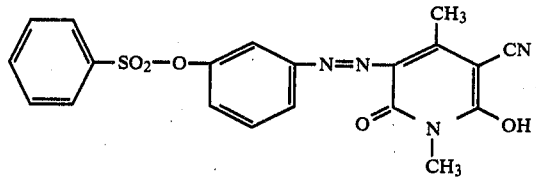

1.5 g/l of the disperse dye of the formula,

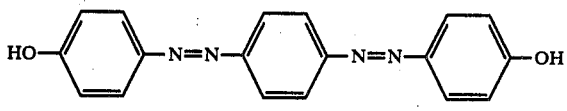

12.5 g/l of the reactive dye of the formula,

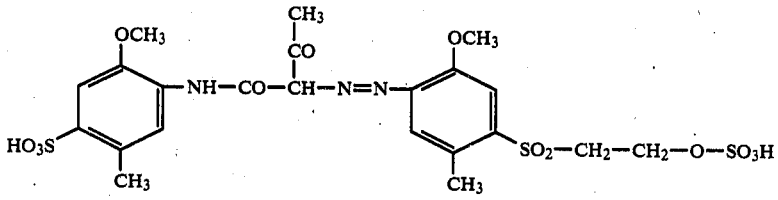

and 6.3 g/l of the reactive dye of the formula,

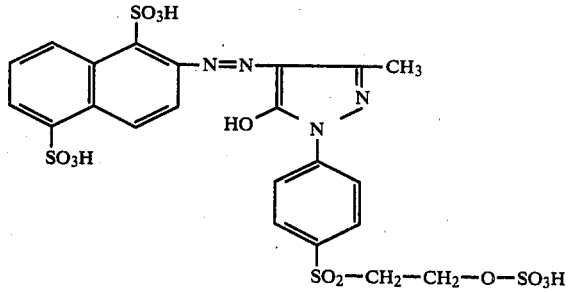

(the dyestuffs being present in a commercial form and quality).

After the padding, the textile goods thus treated are steamed to fix the dyestuff for 5 minutes at 180° C., while using superheated steam. Subsequently the dyeing is aftertreated at boiling for 10 minutes with an aqueous bath, while adding 0.5 g/l of the reaction product of 1 mol of nonyl phenol with 8 mols of ethylene oxide.

A uniform yellow dyeing is obtained on both fiber portions of the fabric.

In order to improve the fixation of the disperse dyestuffs, 15 g/l of a fixation accelerator based on a mixture of alkyl and aryl oxethylates may be added to the padding liquor.

EXAMPLE 2:

As described in Example 1, a mixed fabric of polyester fibers/cotton (67/33) is padded, at a liquor pick-up of 70% (of the weight of the dry goods), with an aqueous padding liquor at a temperature of 30° C. containing 18 g/l of the dyestuff Disperse Blue 56 having the C.I. No. 63 285, 5 g/l of the dyestuff Disperse Brown 1 having the C.I. No. 11 152, 5 g/l of the disperse dye of the formula,

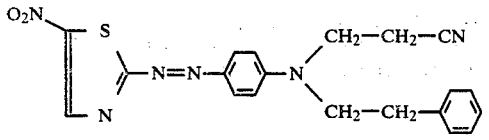

20 g/l of the reactive dye of the formula

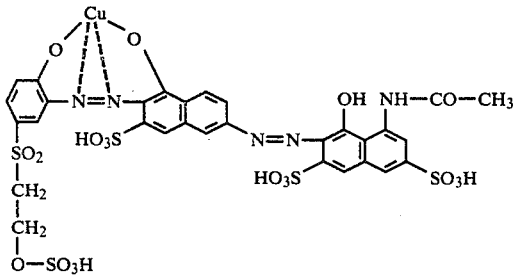

(the dyestuffs being present in a commercial form and quality), and 10 g/l of an auxiliary agent based on a mixture of alkyl and aryl oxethylates.

Subsequently the textile goods are pressure-steamed to fix the two dyestuff classes for 10 minutes at 125° C. The aftertreatment of the dyeing is effected as in Example 1.

A full blue dyeing of the fabric is obtained with a good tone-in-tone hiding of the two fiber portions.

EXAMPLE 3:

A mixed fabric of 67 parts of polyester fibers and 33 parts of cotton is printed with a printing paste which contains, per kg, 30 g of the dyestuff Disperse Red 60 having the C.I. No. 60 756, 30 g of the reactive dye of the formula,

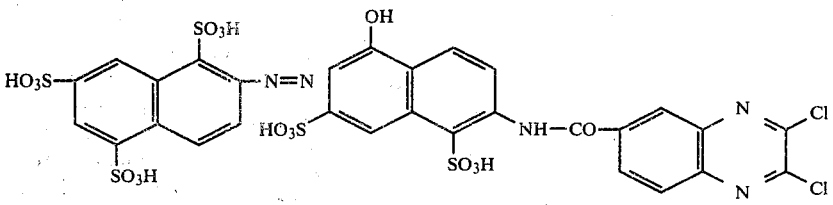

(the dyestuffs being present in a commerical form and quality), 600 g of alginate thickener (4% strength) and 340 g of water 1000 g of printing paste After printing, the fabric is steamed to fix the dyestuff for 5 minutes in a pressure steamer at 130° C. The print obtained is then rinsed with hot water, soaped for 5 minutes, while hot, in a neutral aqueous bath with the addition of 0.5 g/l of a non-ionogenic detergent, then rinsed again with water and dried.

As a result, brilliant and even red prints with a shot effect are obtained on both fiber portions, the color depth corresponding to the dyestuff yields that may be obtained with conventional printing processes.

EXAMPLE 4:

A fabric of mercerized cotton is padded, with a liquor pick-up of 80% (of the weight of the dry goods), with an aqueous padding liquor of about 50° C. having the following composition:

22 g/l of the reactive dye of the formula

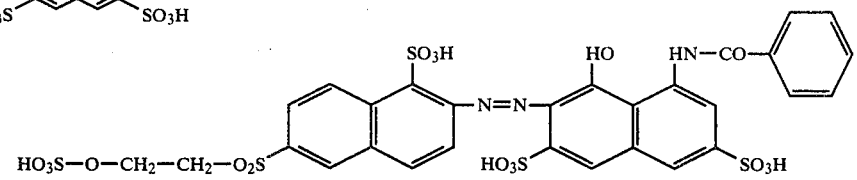

and 4 g/l of the reactive dye of the formula

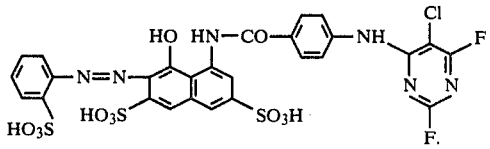

After the padding, the textile goods are subjected to a thermosol process for 60 seconds at 210° C. to fix the dyestuff, and are then rinsed with hot and cold water.

A bluish red dyeing is obtained.

The same dyeing result is obtained if the fixation is carried out with high temperature steam within 6 minutes at 180° C.

What is claimed is:

1. In a process for fixing a dyestuff which has been applied to a web-like textile, consisting of or containing cellulose fibers, with an aqueous padding liquor or printing paste containing one or more reactive dyes, or said liquor or paste containing a thickener, padding auxiliary, or mixture thereof in addition to said one or more reactive dyes, the initial pH value of said liquor or paste being in the slightly acid range, the improvement which comprises contacting the dyestuff on the web-like textile with steam at high pressure, without the addition of an alkali or alkali-yielding agent.

2. A process as defined in claim 1, which comprises contacting the dyestuff on the web-like textile with pressurized, saturated steam at a temperature of from 105° to 140° C. for a time of from 2 to 30 minutes.

3. In a process for fixing a dyestuff which has been applied to a web-like textile, consisting of or containing cellulose fibers, with an aqueous padding liquor or printing paste containing one or more reactive dyes, or said liquor or paste containing a thickener, padding auxiliary, or mixture thereof in addition to said one or more reactive dyes, the initial pH value of said liquor or paste being in the slightly acid range, the improvement which comprises contacting the dyestuff on the web-like textile with steam at high temperature, without the addition of an alkali or alkali-yielding agent.

4. A process as defined in claim 3, which comprises contacting the dyestuff on the web-like textile with superheated steam at a temperature of from 160° to 190° C. for a time of from 3 to 7 minutes.

5. In a process for fixing a dyestuff which has been applied to a web-like textile, consisting of or containing cellulose fibers, with an aqueous padding liquor or printing paste containing one or more reactive dyes, or said liquor or paste containing a thickener, padding auxiliary or mixture thereof in addition to said one or more reactive dyes, the initial pH value of said liquor or paste being in the slightly acid range, the improvement which comprises subjecting the dyestuff on the web-like textile to dry heat, without the addition of an alkali or alkali-yielding agent.

6. A process as defined in claim 5, which comprises subjecting the dyestuff on the web-like textile to dry heat at a temperature of from 180° to 230° C. for a time of from 45 to 120 seconds.

7. A process as defined in claim 1, 2, 3, 4, 5 or 6, wherein the web-like textile contains cellulose and polyester fibers and wherein the padding liquor or printing paste additionally contains one or more disperse dyes, but does not contain an acid-yielding agent.

8. A process as defined in claim 7, wherein the padding liquor or printing paste additionally contains one or more hydrotropic agents.

9. A process as defined in claim 1, 2, 3, 4, 5 or 6, which further comprises after-treating the dyed or printed textile, following the heat fixation of the dyestuff, without adding an alkali or alkali-yielding agent and without adding an acid or acid-yielding agent.

* * * * *